US012433452B1

(12) United States Patent
Zhang

(10) Patent No.: US 12,433,452 B1
(45) Date of Patent: Oct. 7, 2025

(54) FOLDABLE BATHTUB

(71) Applicant: Jinhua Gica Baby Products Co., Ltd., Zhejiang (CN)

(72) Inventor: Xiaoyu Zhang, Zhejiang (CN)

(73) Assignee: Jinhua Gica Baby Products Co., Ltd., Zhejiang (CN)

( * ) Notice: Subject to any disclaimer, the term of this patent is extended or adjusted under 35 U.S.C. 154(b) by 0 days.

(21) Appl. No.: 18/965,266

(22) Filed: Dec. 2, 2024

(51) Int. Cl.
*A47K 3/06* (2006.01)

(52) U.S. Cl.
CPC ..... *A47K 3/06* (2013.01)

(58) Field of Classification Search
CPC ..... A47K 3/06
See application file for complete search history.

(56) References Cited

U.S. PATENT DOCUMENTS 11,937,745 B2 * 3/2024 Yang ..... A47K 3/06
12,178,367 B1 * 12/2024 Chen ..... A47K 3/06
12,213,630 B1 * 2/2025 Lei ..... A47K 3/06

FOREIGN PATENT DOCUMENTS

WO WO-2008153334 A1 * 12/2008 ..... A47K 3/022

* cited by examiner

*Primary Examiner* — Christine J Skubinna

(74) *Attorney, Agent, or Firm* — Hawaii Patent Services; Nathaniel K. Fedde; Kenton N. Fedde

(57) ABSTRACT

Disclosed is a foldable bathtub. The foldable bathtub includes a tub body and a supporting ring, where the supporting ring includes a left ring portion and a right ring portion, where two connecting assemblies are symmetrically arranged between the left ring portion and the right ring portion, and each connecting assembly includes a first connecting member, where the first connecting member includes a first body and first hinge shafts, and a resisting member is further arranged on the first connecting member; and supporting legs are arranged on the supporting ring. During folding, the left ring portion or the right ring portion rotates around the connecting assemblies without disassembling the connecting assemblies, and thus operation is simple.

16 Claims, 6 Drawing Sheets

FOLDABLE BATHTUB

TECHNICAL FIELD

The present disclosure relates to the technical field of bathtubs, and in particular to a foldable bathtub.

BACKGROUND

As urbanization accelerates, a number of households have limited bathroom space, and the bathroom space of a number of households cannot accommodate a bathtub since the bathtub generally occupies a large area, so a foldable bathtub has emerged on market. The foldable bathtub is convenient and lightweight, and is directly folded and stored without occupying the bathroom space when not in use. Moreover, it may also be taken away together during moving, and is convenient to carry without increasing burden of moving after folded and stored. However, the foldable bathtub on the market generally has a complex folding mechanism, which requires punching, positioning, and locking during production to achieve connection. As a result, mounting is complex, and production efficiency is low.

Patent document with publication number U.S. Ser. No. 11/937,745B2 disclosed a foldable bathtub. The foldable bathtub includes a tub body and a supporting ring, where the supporting ring is arranged on the tub body; and the supporting ring includes: a left ring portion and a right ring portion, which are arranged at two sides of an upper end of the tub body respectively; and an upper folding portion, which is arranged between the left ring portion and the right ring portion. The upper folding portion is made of a flexible material, and the supporting ring is rotatably folded between the left ring portion and the right ring portion by means of deformation of the upper folding portion. Moreover, the supporting ring is folded to drive the tub body to deform and be folded. Thus, the left ring portion is connected to the right ring portion by means of the upper folding portion made of the flexible material, and a structure is simple accordingly. The upper folding portion, the left ring portion, and the right ring portion of the foldable bathtub are integrally formed, and consequently, a producer does not need to additionally perform a mounting operation, mounting steps are simple, and production efficiency is high.

However, a lower surface of the upper folding portion of the foldable bathtub is provided with a detachable limiting block, and the left ring portion is connected to the right ring portion by means of the limiting block, such that the bathtub is limited in a using state. It is necessary to disassemble the limiting block when the bathtub is folded and stored. Such a detachable limiting structure will be separated under a significant external force during use, resulting in danger by an unstable structure. Furthermore, with frequent repeated detaching and mounting steps, the limiting block will not be firmly connected to the left ring portion and the right ring portion, resulting in great inconvenience to use.

SUMMARY

The problem to be solved by the present disclosure is the technical problem that a foldable bathtub is not firmly connected at a folded portion.

In order to achieve the above objective, the technical solution of the present disclosure is as follows: a foldable bathtub includes a tub body and a supporting ring connected to a top edge of the tub body, where the supporting ring includes a left ring portion and a right ring portion, where the left ring portion and the right ring portion are arranged at two ends of the tub body respectively; two connecting assemblies are symmetrically arranged between the left ring portion and the right ring portion, one ends of the connecting assemblies are hinged to the left ring portion, and the other ends of the connecting assemblies are hinged to the right ring portion; end portions of the left ring portion and the right ring portion are provided with hinge holes; each connecting assembly includes a first connecting member, where the first connecting member includes a first body and first hinge shafts located at two sides of the first body, where the first hinge shafts are in clearance fit with the hinge holes, and a resisting member for preventing the first connecting member from separating from the supporting ring is further arranged on the first connecting member; avoidance space corresponding to positions of the connecting assemblies is arranged on the supporting ring and/or the tub body; and two or above supporting legs are arranged on the supporting ring.

According to the solution, the left ring portion and the right ring portion of the supporting ring are connected by means of the connecting assemblies, and the left ring portion and the right ring portion are hinged to the connecting assemblies; during folding, the left ring portion or the right ring portion rotates around the connecting assemblies without disassembling the connecting assemblies, and thus operation is simple; and the supporting ring at two ends of the connecting assemblies is limited by means of the connecting assemblies, such that the left ring portion and the right ring portion are firmly connected at folded portions.

BRIEF DESCRIPTION OF THE DRAWINGS

In order to more clearly illustrate the technical solutions of the present application, the accompanying drawings required for the embodiments will be briefly introduced below. Obviously, the accompanying drawings in the following description are only some embodiments of the present application, and those of ordinary skill in the art would further be able to derive other accompanying drawings from these accompanying drawings without making creative efforts.

DETAILED DESCRIPTIONS OF THE EMBODIMENTS

The present disclosure will be further described in detail below with reference to the accompanying drawings and the particular embodiments.

Figure 1:
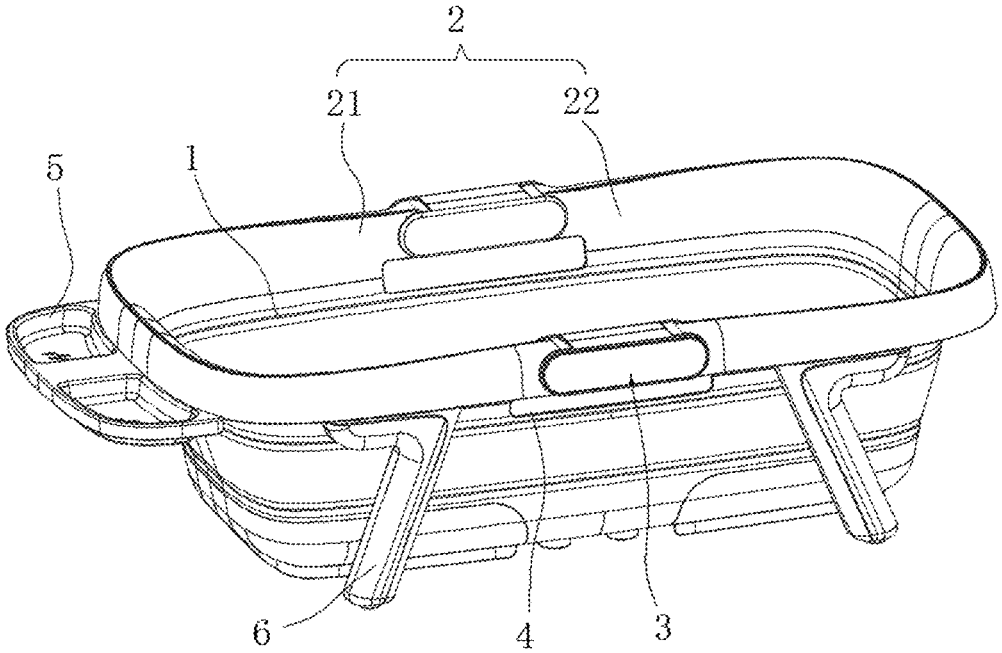
FIG. 1 is a schematic diagram of an overall structure of an example of the present disclosure.
Figure 2:
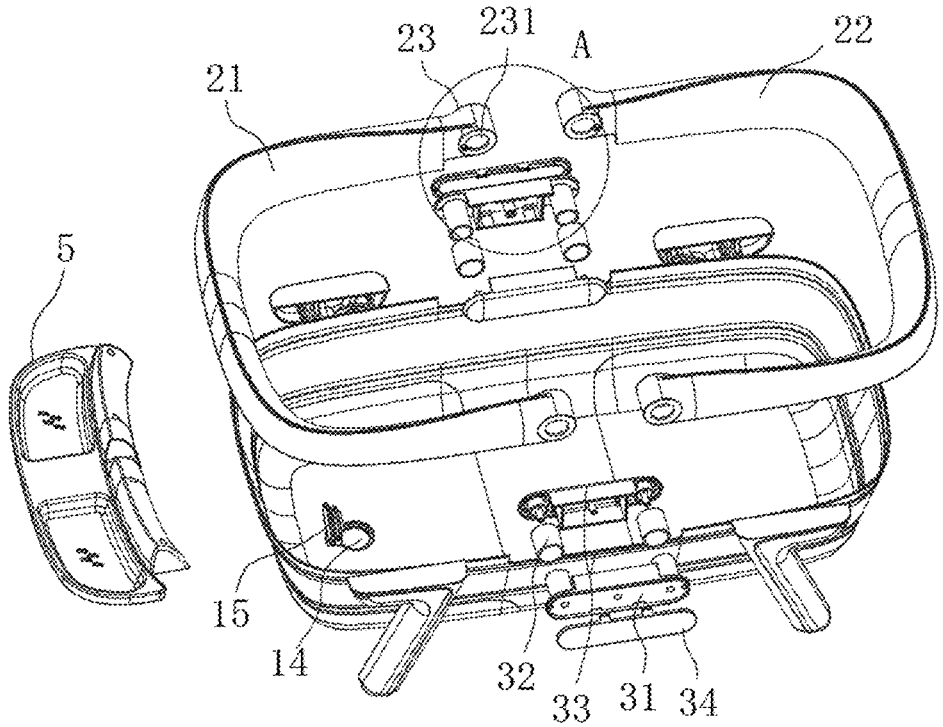
FIG. 2 is a schematic exploded view of an overall structure of an example of the present disclosure.

As shown in FIGS. 1 and 2, a foldable bathtub includes a tub body 1 and a supporting ring 2 connected to a top edge of the tub body 1, where the supporting ring 2 includes a left ring portion 21 and a right ring portion 22, where the left ring portion 21 and the right ring portion 22 are arranged at two ends of the tub body 1 respectively.

In the example, the tub body 1 is made of a flexible material, such as thermoplastic polyurethane (TPU), thermoplastic rubber (TPR) or thermoplastic elastomer (TPE); and the supporting ring 2 is made of a hard plastic material, such as polycarbonate (PC), acrylonitrile butadiene styrene (ABS), polyamide (PA), polyamide 66 (PA66) or polystyrene (PS), and the tub body 1 and the supporting ring 2 are molded into a whole according to a double injection molding process.

Two connecting assemblies 3 are symmetrically arranged between the left ring portion 21 and the right ring portion 22, one ends of the connecting assemblies 3 are hinged to the left ring portion 21, and the other ends of the connecting assemblies 3 are hinged to the right ring portion 22. When it is necessary to store the foldable bathtub, the left ring portion 21 and the right ring portion 22 may be folded relative to each other by means of hinge structures of the connecting assemblies 3, thereby reducing overall space occupied by the bathtub.

During production, a main structure of the bathtub may be formed only by assembling the connecting assemblies 3 between the left ring portion 21 and the right ring portion 22.

Figure 3:
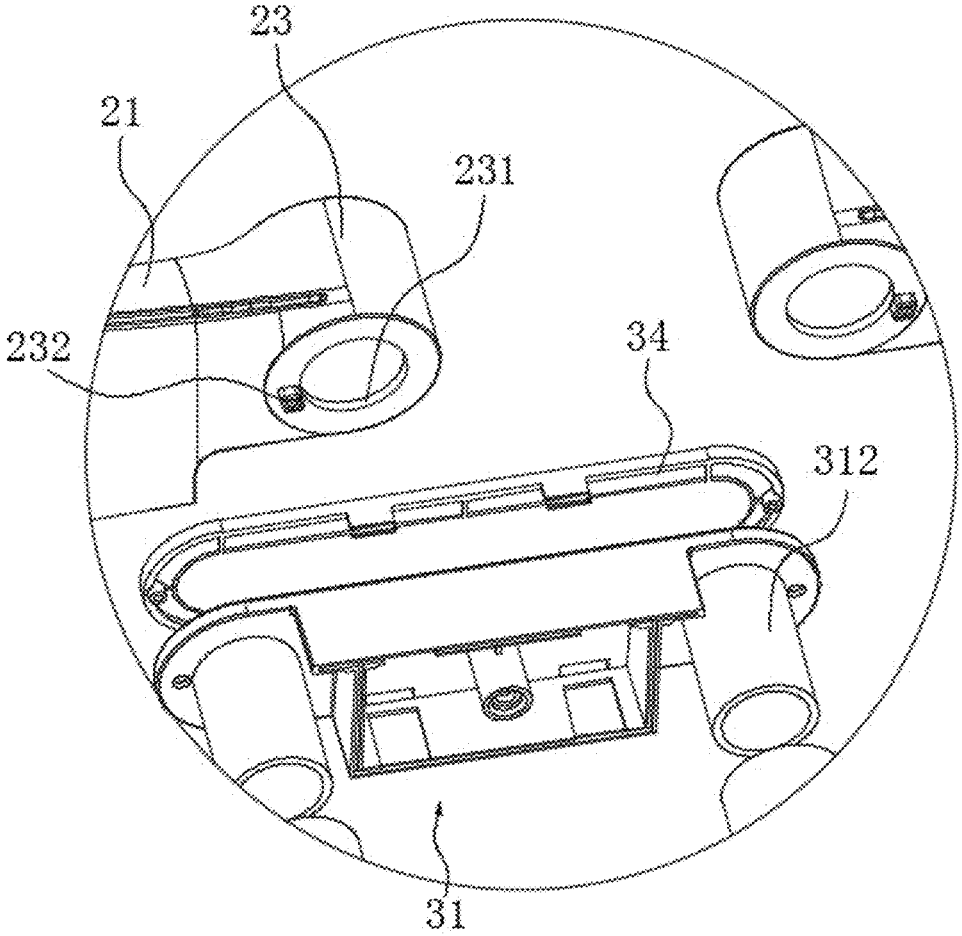
FIG. 3 is a schematic enlarged view of a portion Ain FIG. 2.

As shown in FIGS. 2 and 3, in the example, the end portions of the left ring portion 21 and the right ring portion 22 are provided with connecting portions 23 having U-shaped cross sections, end portions of the connecting portions 23 are cambered, the hinge holes 231 are provided on the connecting portions 23 of the left ring portion 21 and the right ring portion 22, and the hinge holes 231 penetrate the connecting portions 23.

In the example, the above U-shaped connecting portions 23 and the above hinge holes 231 are formed during injection molding.

Figure 4:
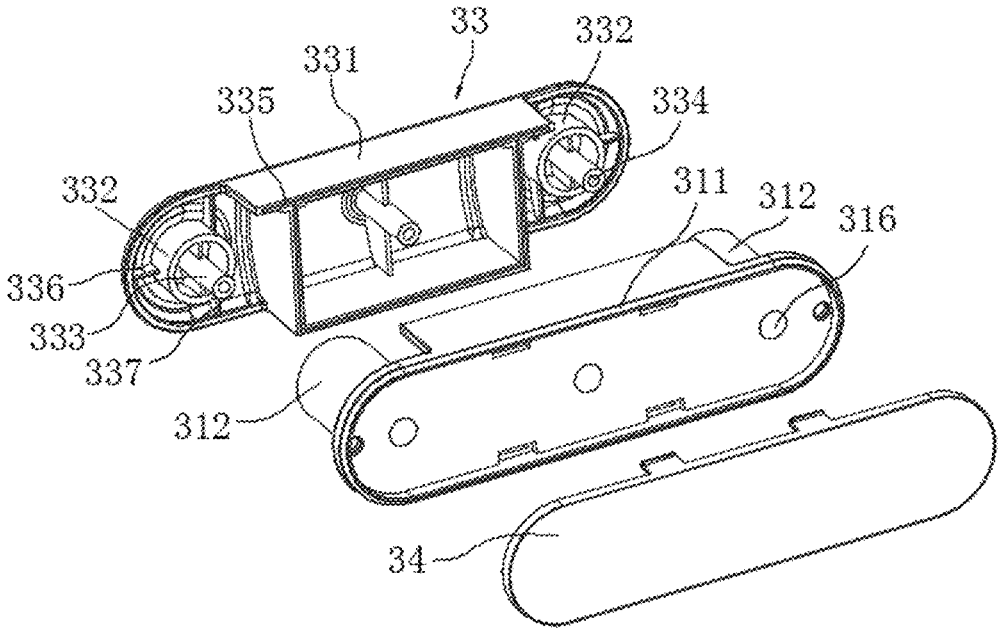
FIG. 4 is a schematic structural exploded view of a connecting assembly in an example of the present disclosure.

As shown in FIG. 4, the connecting assembly 3 includes a first connecting member 31, where the first connecting member 31 includes a first body 311 and first hinge shafts 312 located at two sides of the first body 311.

During mounting, the first hinge shafts 312 pass through the hinge holes 231 on the connecting portions 23 of the left ring portion 21 and the right ring portion 22 respectively. Usually, the first hinge shafts 312 are in clearance fit with the hinge holes 231, such that the left ring portion 21 and the right ring portion 22 may flexibly rotate around the first hinge shafts 312. Certainly, since the first hinge shafts 312, the left ring portion 21 and the right ring portion 22 are usually made of plastic, and the plastic has elasticity to some extent, interference or transition fit may also be used between the first hinge shafts 312 and the hinge holes 231. Thus, there is a resistance to some extent during rotation, and thus hand feeling is desirable during rotation.

As shown in FIGS. 2-5, a resisting member for preventing the first connecting member 31 from separating from the supporting ring 2 is further arranged on the first connecting member 31, so as to improve stability of the bathtub during use. Moreover, reinforcing rings 32 sleeve the first hinge shafts 312, and two ends of the reinforcing rings 32 are located in the connecting portions 23. The reinforcing rings 32 resist two sides of the connecting portions 23, such that an inner edge and an outer edge of the supporting ring may not deform when the supporting ring 2 is gripped, thereby improving stability of an overall structure.

In the example, the resisting member is a second connecting member 33. The second connecting member 33 includes a second body 331 and second hinge shafts 332 located at two sides of the second body 331.

Figure 5:
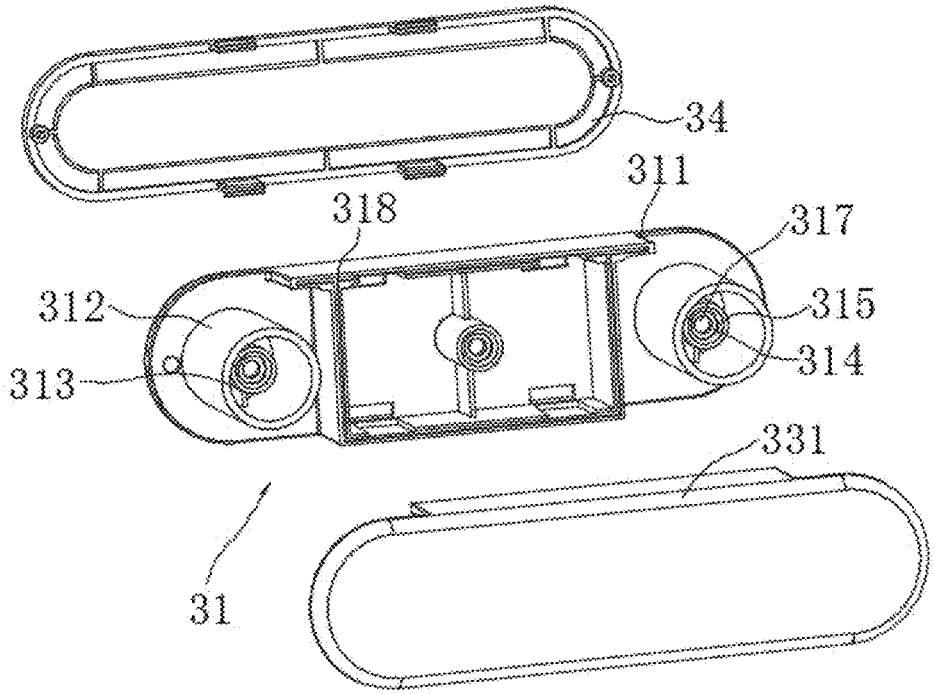
FIG. 5 is a schematic structural exploded view of a connecting assembly from another perspective in an example of the present disclosure.

As shown in FIGS. 4 and 5, the first hinge shafts 312 are of hollow structures, first connecting columns 313 are arranged inside the first hinge shafts 312, third counterbores 314 are provided at end portions of the first connecting columns 313, and chamfers 315 for insertion of the second connecting columns 333 are provided at openings of the third counterbores 314; and second connecting columns 333 are arranged inside the second hinge shafts 332, first counterbores 316 extending from an outer side to an inner side of the first body 311 are provided on the first connecting columns 313, first through holes 317 are provided at bottoms of the first counterbores 316, and second counterbores 334 are provided on the second connecting columns 333.

During assembly, the second hinge shafts 332 are inserted into the first hinge shafts 312, and the second connecting columns 333 are inserted into the third counterbores 314 by means of the chamfers 315; screws pass to be put into the first counterbores 316, and the screws pass through the first through holes 317 and are tightened into the second counterbores 334, such that the first body 311 and the second body 331 are fixedly connected. By means of such an embedded connecting structure, the first connecting member 31 and the second connecting member 33 are not easy to axially displace after connection, and stability of connection may be effectively enhanced. In a process of frequently folding and unfolding the bathtub, such a stable connection may prevent loosening between the first connecting members 31 and the second connecting members 33, and ensure structural stability of the supporting ring 2.

In the example, a positioning recess 318 is further provided on the first body 311, a positioning boss 335 is arranged on the second body 331, and the positioning boss 335 is inserted into the positioning recess 318 when the first connecting member 31 is connected to the second connecting member 33, such that the first connecting member 31 and the second connecting member 33 mat be accurately aligned in a connecting process, and such accurate alignment ensures that other connecting parts such as the first hinge shafts 312 and the second hinge shafts 332, the first connecting columns 313 and the second connecting columns 333 may also be accurately matched, thereby ensuring stability and reliability of a whole connecting structure. Moreover, matching between the positioning boss 335 and the positioning recess 318 increases a contact area between the first connecting member 31 and the second connecting member 33, thereby further enhancing stability of connection between the first connecting member 31 and the second connecting member 33.

As shown in FIG. 4, in the example, a first baffle 336 and a second baffle 337 are arranged on the second connecting member 33, the first baffle 336 is located at one side of one second hinge shaft 332 close to outside, and the second baffle 337 is located at one side of one second hinge shaft 332 close to a bottom. In an unfolded state of the bathtub, the first baffle 336 is transversely arranged relative to the bathtub, and the second baffle 337 is vertically arranged relative to the bathtub. As shown in FIG. 3, stoppers 232 are arranged at inner sides of the connecting portions 23 of the left ring portion 21 and the right ring portion 22, and the stoppers 232 are arranged at one sides of the hinge holes 231 away from the end portions of the connecting portions 23. During mounting, the second connecting member 33 passes through the hinge holes 231 at inner sides of the connecting portions of the left ring portion 21 and the right ring portion 22, such that the stoppers 232 are located below the first baffle 336, and the stoppers 232 are limited to move in space from space below the first baffle 336 to one side of the second baffle 337. When the bathtub is unfolded, the stoppers 232 abut against a lower portion of the first baffle 336 to maintain the bathtub in the unfolded state. When the bathtub is folded, the stoppers 232 abut against one side of the second baffle 337 close to the first baffle 336.

In the example, two ends of the first connecting member 31 are semicircular, and two ends of the second connecting member 33 are semicircular, such that rotation is facilitated. Moreover, a periphery of the bathtub is smooth, thereby preventing edges from causing harm to a user.

Figure 6:
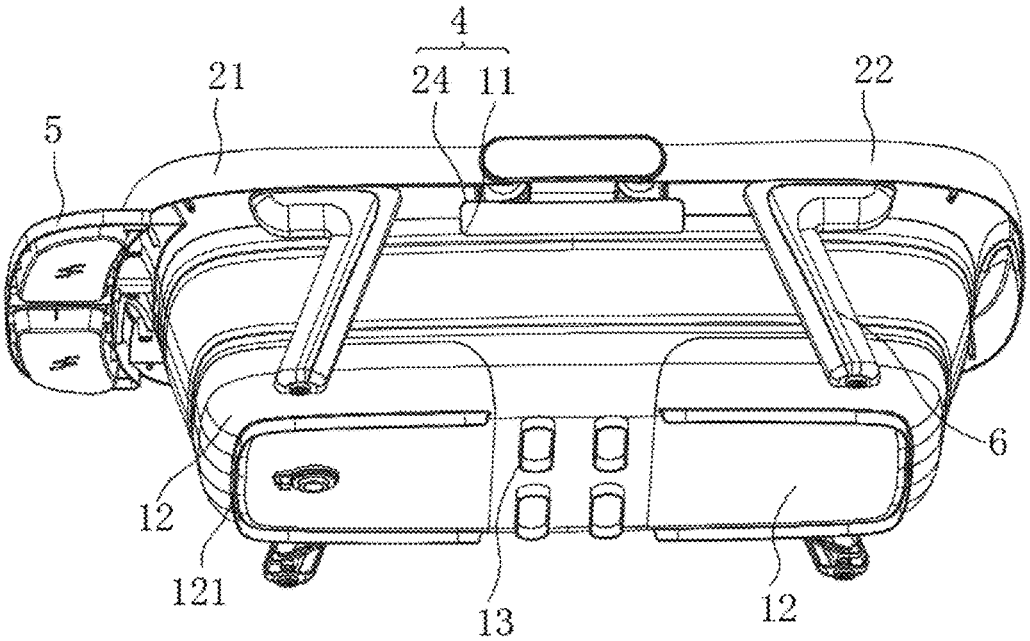
FIG. 6 is a schematic diagram of an overall structure from another perspective in an example of the present disclosure.

As shown in FIG. 6, in the example, an outer edge of the supporting ring 2 is folded downwards to form an inverted U-shaped structure, thereby driving the tub body 1 connected to the supporting ring 2 to be folded towards a middle; and an inner edge of the supporting ring 2 has a height greater than that of an outer edge, where the inner edge is connected to the tub body 1.

In the example, a first notch 24 is provided on a portion of the inner edge of the supporting ring 2 close to the connecting portions 23, a second notch 11 is provided on the tub body 1 located below the first notch 24, the second notch 11 has a length greater than that of the first connecting member 31, and the first notch 24 and the second notch 11 together form avoidance space 4. When the bathtub is folded, the avoidance space 4 may accommodate a portion pressed and stacked after the tub body 1 is bent, thereby completely folding the bathtub.

Certainly, the avoidance space 4 mat also be only arranged on the tub body 1 or the supporting ring, and the bathtub may also be completely folded.

As shown in FIG. 4, in the example, a cover plate 34 is arranged outside the first connecting member 31 by means of a buckle, and a screw connecting the first connecting member 31 and the second connecting member 33 is hidden by means of the cover plate 34, such that the bathtub looks beautiful.

As shown in FIG. 6, two ends of a bottom of the tub body 1 are each provided with a base 12, and a first supporting flange 121 is arranged at a bottom of the base 12. In the example, the base 12 is made of a hard plastic material, and the base 12 and the tub body 1 are also made according to a double injection molding process. Different materials may be closely combined according to such a process, and in an injection molding process, two materials fuse with each other under conditions such as a temperature and a pressure to some extent, so as to form a whole. Compared with a traditional connection method (such as glue sticking and mechanical connection), connection formed according to the double injection molding process is firmer. Thus, parts may be effectively prevented from being separated during use.

As shown in FIG. 6, a second supporting flange 13 is further arranged on the tub body 1 between the two bases 12, and during unfolding, a top surface of the first supporting flange 121 is flush with a height of the second supporting flange 13. During use, a bottom of the tub body 1 of the bathtub is prevented from directly making friction contact with ground. Since the basin body 1 of the bathtub is made of a flexible material, friction with the ground for a long time may cause damage to the tub body 1. The first supporting flange 121 and the second supporting flange 13 make contact with the ground, thereby preventing the tub body 1 from making direct contact with the ground. A water discharging hole 14 is further provided in the tub body 1, a water discharging hole cover 15 is arranged at one side of the water discharging hole 14 at an inner side of the tub body 1, and the water discharging hole cover 15 covers the water discharging hole 14. After bathing, a user only needs to lift the water discharging hole cover 15, and water in the tub body 1 may flow out of the tub body 1 by means of the water discharging hole 14, such that the water is poured out without carrying the bathtub with difficulty.

In the example, a shelf 5 is arranged at an end portion of the supporting ring 2, the shelf 5 extends into the supporting ring 2, and the shelf 5 and the supporting ring 2 are fastened by means of a screw. When the user uses the bathtub, some bathing articles, such as shampoo, body wash and towels, may be placed on the shelf 5, such that it is convenient for the user to take and put the bathing articles at any time.

In the example, four supporting legs 6 are arranged on the supporting ring 2. When the bathtub is folded and stored, the four supporting legs 6 may be disassembled and stored separately, and the tub body 1 and the supporting ring 2 are folded back and stored. In another example, two supporting legs 6 are provided, and the supporting legs 6 may be folded between an inner edge and an outer edge of the supporting ring 2, such that the supporting legs are stowed between the inner edge and the outer edge of the supporting ring 2, and the tub body 1 and the supporting ring 2 are folded back and stored.

Figure 7:
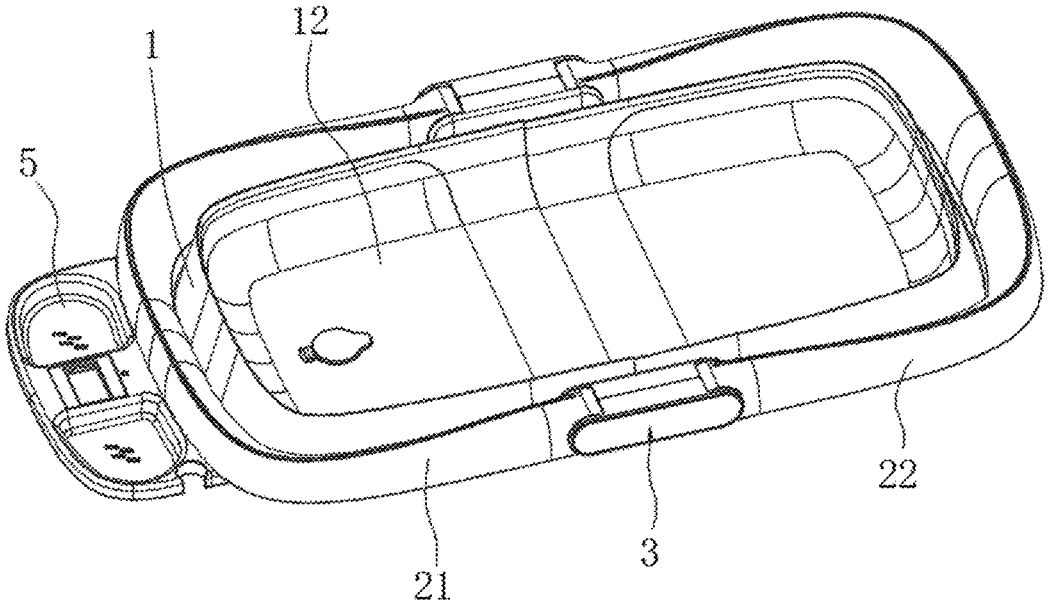
FIG. 7 is a schematic diagram showing a folded state of a tub body of an example of the present disclosure.
Figure 8:
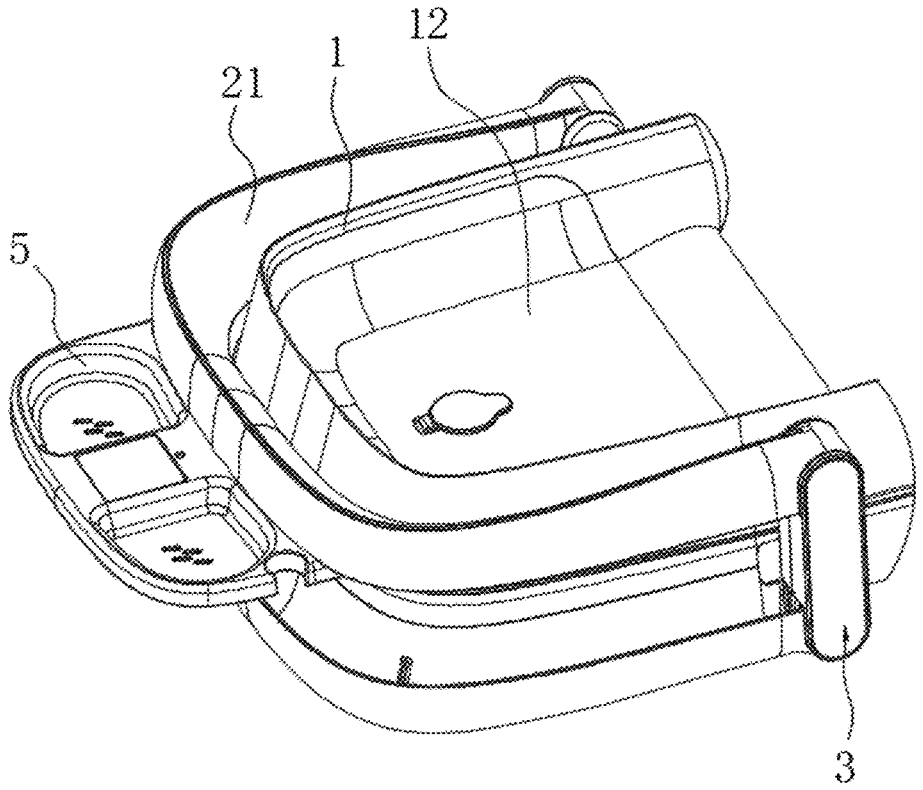
FIG. 8 is a schematic diagram showing a folded state of a whole of an example of the present disclosure.

As shown in FIGS. 7 and 8, when the bathtub needs to be folded and stored, the supporting legs 6 are disassembled and stored or folded and stored, then the tub body 1 is folded towards the supporting ring 2, and then the right ring portion 22 is folded downwards to drive the connecting assemblies 3 to rotate downwards around the connecting portion 213 of the left ring portion 21. After the right ring portion 22 rotates to a state perpendicular to the left ring portion 21, the right ring portion 22 is folded towards a bottom of the left ring portion 21, and when a bottom of the right ring part 22 abuts against the bottom of the left ring part 21, the bathtub is in a completely folded state.

In the above structure, the left ring portion 21 and the right ring portion 22 are connected by means of the connecting assemblies 3, and the left ring portion 21 and the right ring portion 22 are rotatably folded around the connecting assemblies 3, such that operation is simple, reliability is excellent, and folded parts do not need to be disassembled. The first baffle 336 and the second baffle 337 are arranged on the second connecting member 33, and the stoppers 232 are arranged at the inner sides of the connecting portions 23 of the left ring portion 21 and the right ring portion 22, and the stoppers 232 are limited by means of the first baffle 336 and the second baffle 337, such that the bathtub may be stably maintained in the unfolded state.

The technical means disclosed in the solution of the present disclosure is not limited to the technical means disclosed in the above embodiments, but also include technical solutions consisting of any combination of the above technical features. It should be pointed out that those of ordinary skill in the art can further make several improvements and modifications without departing from the principle of the present disclosure, and these improvements and modifications should also fall within the scope of protection of the present disclosure.

What is claimed is:

1. A foldable bathtub, comprising: a tub body and a supporting ring connected to a top edge of the tub body, wherein the supporting ring comprises a left ring portion and a right ring portion, wherein the left ring portion and the right ring portion are arranged at two ends of the tub body respectively;

wherein:

two connecting assemblies are symmetrically arranged between the left ring portion and the right ring portion, one end of each of the connecting assemblies is hinged to the left ring portion, and another end of each of the connecting assemblies is hinged to the right ring portion;

end portions of the left ring portion and the right ring portion are provided with hinge holes;

each of the connecting assemblies comprises a first connecting member, wherein the first connecting member comprises a first body and first hinge shafts located at two sides of the first body, wherein the first hinge shafts are in clearance fit with the hinge holes, and a resisting member for preventing the first connecting member from separating from the supporting ring is further arranged on the first connecting member;

avoidance space corresponding to positions of the connecting assemblies is arranged on the supporting ring and/or the tub body;

two or more supporting legs are arranged on the supporting ring; and the end portions of the left ring portion and the right ring portion are provided with connecting portions having U-shaped cross sections, end portions of the connecting portions are cambered, the hinge holes are provided on the connecting portions, and the hinge holes penetrate the connecting portions.

2. The foldable bathtub according to claim 1, wherein stoppers are arranged at inner sides of the connecting portions, and the stoppers are arranged at one sides of the hinge holes away from the end portions of the connecting portions.

3. A foldable bathtub, comprising: a tub body and a supporting ring connected to a top edge of the tub body, wherein the supporting ring comprises a left ring portion and a right ring portion, wherein the left ring portion and the right ring portion are arranged at two ends of the tub body respectively;

wherein:

two connecting assemblies are symmetrically arranged between the left ring portion and the right ring portion, one end of each of the connecting assemblies is hinged to the left ring portion, and another end of each of the connecting assemblies is hinged to the right ring portion;

end portions of the left ring portion and the right ring portion are provided with hinge holes;

each of the connecting assemblies comprises a first connecting member, wherein the first connecting member comprises a first body and first hinge shafts located at two sides of the first body, wherein the first hinge shafts are in clearance fit with the hinge holes, and a resisting member for preventing the first connecting member from separating from the supporting ring is further arranged on the first connecting member;

avoidance space corresponding to positions of the connecting assemblies is arranged on the supporting ring and/or the tub body;

two or more supporting legs are arranged on the supporting ring;

the resisting member comprises a second connecting member, wherein the second connecting member comprises a second body and second hinge shafts located at two sides of the second body; and the first hinge shafts are of hollow structures, and the second hinge shafts are inserted into the first hinge shafts.

4. The foldable bathtub according to claim 3, wherein first connecting columns are arranged inside the first hinge shafts, and second connecting columns are arranged inside the second hinge shafts; first counterbores extending from an outer side to an inner side of the first body are provided on the first connecting columns, first through holes are provided at bottoms of the first counterbores, second counterbores are provided on the second connecting columns, and during mounting, screws pass through the first through holes and are tightened into the second counterbores.

5. The foldable bathtub according to claim 4, wherein third counterbores are provided at end portions of the first connecting columns, and chamfers for insertion of the second connecting columns are arranged at openings of the third counterbores.

6. The foldable bathtub according to claim 1, wherein reinforcing rings sleeve the first hinge shafts, and two ends of the reinforcing rings are located in the connecting portions.

7. The foldable bathtub according to claim 3, wherein a positioning recess is provided on the first body; and a positioning boss is arranged on the second body, and the positioning boss is inserted into the positioning recess when the first connecting member and the second connecting member are combined into one connecting assembly.

8. The foldable bathtub according to claim 3, wherein a first baffle and a second baffle are arranged on the second connecting member, the first baffle is located at one side of one second hinge shaft close to outside, and the second baffle is located at one side of one second hinge shaft close to a bottom.

9. The foldable bathtub according to claim 3, wherein two ends of the first connecting member are semicircular; and two ends of the second connecting member are semicircular.

10. A foldable bathtub, comprising: a tub body and a supporting ring connected to a top edge of the tub body, wherein the supporting ring comprises a left ring portion and a right ring portion, wherein the left ring portion and the right ring portion are arranged at two ends of the tub body respectively;

wherein:

two connecting assemblies are symmetrically arranged between the left ring portion and the right ring portion, one end of each of the connecting assemblies is hinged to the left ring portion, and another end of each of the connecting assemblies is hinged to the right ring portion;

end portions of the left ring portion and the right ring portion are provided with hinge holes;

each of the connecting assemblies comprises a first connecting member, wherein the first connecting member comprises a first body and first hinge shafts located at two sides of the first body, wherein the first hinge shafts are in clearance fit with the hinge holes, and a resisting member for preventing the first connecting member from separating from the supporting ring is further arranged on the first connecting member;

avoidance space corresponding to positions of the connecting assemblies is arranged on the supporting ring and/or the tub body;

two or more supporting legs are arranged on the supporting ring; and an outer edge of the supporting ring is folded downwards to form an inverted U-shaped structure, and an inner edge of the supporting ring has a height greater than that of an outer edge of the supporting ring.

11. The foldable bathtub according to claim 10, wherein the avoidance space comprises a first notch provided on the inner edge of the supporting ring and a second notch provided on the tub body; and the second notch has a length greater than that of the first connecting member.

12. The foldable bathtub according to claim 1, wherein a cover plate is arranged outside the first connecting member by means of a buckle.

13. The foldable bathtub according to claim 1, wherein the tub body is made of a flexible material; and the supporting ring is made of a hard material, and the tub body and the supporting ring are made according to a double injection molding process.

14. The foldable bathtub according to claim 1, wherein two ends of a bottom of the tub body are each provided with a base, a bottom of the base is provided with a first supporting flange, the base is made of a hard material, and the base and the tub body are made according to a double injection molding process.

15. The foldable bathtub according to claim 14, wherein a second supporting flange is arranged on the tub body between the two bases, and a top surface of the first supporting flange is flush with a height of the second supporting flange during unfolding.

16. The foldable bathtub according to claim 1, wherein a shelf is arranged at an end portion of the supporting ring, the shelf extends into the supporting ring, and the shelf and the supporting ring are fastened by means of screws.

* * * * *